United States Patent [19]

Wheeler

[11] 4,179,856

[45] * Dec. 25, 1979

[54] SANDING SLEEVE ASSEMBLY

[75] Inventor: John H. Wheeler, Dallas, Tex.

[73] Assignee: The Texacone Company, Dallas, Tex.

[ * ] Notice: The portion of the term of this patent subsequent to May 16, 1995, has been disclaimed.

[21] Appl. No.: 865,708

[22] Filed: Dec. 29, 1977

Related U.S. Application Data

[63] Continuation-in-part of Ser. No. 721,984, Sep. 10, 1976, Pat. No. 4,089,137.

[51] Int. Cl.[2] ..... B24B 19/00; B24D 3/22

[52] U.S. Cl. ..... 51/241 S; 51/211 R; 15/104.04; 29/81 F; 175/84

[58] Field of Search ..... 51/241 S, 241 R, 21, 51/73 GC, 204, 211, 181 R, 289, 299 R; 29/81 F, 81 G, 816; 175/84; 15/104.04, 118, 210 B

[56] References Cited

U.S. PATENT DOCUMENTS

| | | | |
|---|---|---|---|
| 190,960 | 5/1877 | Davis | 15/104.04 |
| 471,269 | 3/1892 | Elliot | 184/25 |
| 961,497 | 6/1910 | Horlick | 184/25 |
| 1,370,141 | 3/1921 | McNicholas | 51/73 GC |
| 1,822,521 | 9/1931 | Fox | 15/256.5 |
| 1,898,964 | 2/1933 | Jinnett | 15/104.04 |
| 2,179,465 | 11/1939 | Blazek | 51/73 GC |
| 2,222,191 | 11/1940 | Zisman | 15/104.04 |
| 2,641,008 | 6/1953 | Smith | 15/88 |
| 2,667,929 | 2/1954 | Hunt | 175/84 |
| 2,780,533 | 2/1957 | Hurst | 51/299 |
| 2,782,436 | 2/1957 | Tomer | 15/104.04 |
| 2,813,285 | 11/1957 | Aslin | 15/104.04 |
| 3,117,401 | 1/1964 | Talley | 15/241 R |
| 3,189,935 | 6/1965 | Euga | 15/104.04 |
| 3,258,882 | 7/1966 | Cohen | 51/241 R |
| 3,527,611 | 9/1970 | Newfarmer | 134/6 |
| 4,089,137 | 5/1978 | Wheeler | 51/241 S |

*Primary Examiner*—Robert L. Spruill
*Assistant Examiner*—Roscoe V. Parker
*Attorney, Agent, or Firm*—Richards, Harris & Medlock

[57] ABSTRACT

A sleeve assembly for sanding a piston rod of a hydraulic cylinder or the like comprises a rigid annular outer member, a resilient annular intermediate member adhesively secured to the inner surface of the outer member, and an abrasive annular inner member adhesively secured to the inner surface of the intermediate member for interference contact with the piston rod. The sections of the annular members each have complementary nonaxial end configurations to prevent scoring of the piston rod during axial movement. Clamp means releasably engages the members around the piston rod. In some embodiments, bracket or angle bar means are utilized to releasably secure the sleeve assembly to structure at the end of the cylinder. In another embodiment, the sleeve assembly is releasably clamped directly around the end of the hydraulic cylinder.

21 Claims, 12 Drawing Figures

SANDING SLEEVE ASSEMBLY

CROSS REFERENCE TO RELATED APPLICATION

This application is a continuation-in-part of Application Ser. No. 721,984, filed Sept. 10, 1976, now U.S. Pat. No. 4,089,137.

BACKGROUND OF THE INVENTION

This invention relates generally to a sleeve assembly, and more particularly to a sleeve assembly for sanding and rust removal on piston rods of the type utilized in hydraulic cylinder apparatus.

Hydraulic cylinder apparatus such as hydraulic elevators and the like utilize piston rods which take the form of relatively large diameter pipe sections. It is essential for the proper operation of such hydraulic cylinder apparatus that the piston rods have an outer surface that is free of rust and pits, that has smooth joints between adjacent sections, and that is of substantially uniform diameter throughout its length.

Generally, there are three methods by which a finished piston rod may be formed from an unfinished pipe section. One method is to first engine lathe the section of pipe to the desired diameter, and to then belt sand the pipe section to provide the necessary surface finish. Another method is to utilize a centerless grinder to mill the section of pipe to the desired diameter, and to then utilize a belt sander for finishing. Still another method is to utilize a belt sander for the entire machining and finishing operation. Although these methods are generally satisfactory for the manufacture of piston rods, they are nevertheless characterized by certain problems. Often, the finished piston rods are nonuniform in diameter. Another problem involves the fact that the use of a belt sander sometimes produces a rifling effect.

Long lengths of piston rods are typically formed in sections. Although the joints between adjacent sections of such a piston rod are usually smooth at the time the piston rod is manufactured, it is necessary to disassemble the piston rod for transportation and to subsequently reassemble the piston rod at the time it is installed. Upon reassembly, it is generally not possible to achieve the smooth joints between adjacent sections that were provided when the piston rod was manufactured, so that it is often necessary to sand the piston rod in order to provide smooth joints between adjacent sections.

Other problems related to the installation and use of relatively large diameter piston rods involve the fact that during transportation, such piston rods may sustain damage due to rough handling. Moveover, piston rods of the type utilized in hydraulic elevators and the like are sometimes left exposed at the construction site prior to installation. This can lead to rust and corrosion which must be removed before the piston rod can be installed. If the corrosion is of the electrolytic type, it can result in the surface of the piston rod being pitted to a greater or lesser degree. It has been found to be desirable to substantially fill surface pits of this type before the piston rod is placed in service.

The solution of these heretofore mentioned problems is provided by reference to the present invention, whereby a sleeve assembly having a sanding component is described. For instance, rough joints and some foreign material may be removed from the outer surface of the piston rod by use of the sanding sleeve assembly of the present invention. The sanding sleeve assembly may be utilized on the outer surface of the piston rod by manually moving the assembly over patches of foreign material or by releasably securing the assembly near the stuffing box of the hydraulic cylinder apparatus and actuating the piston rod in an axial direction, thereby sanding the entire outer surface of the piston rod.

SUMMARY OF THE INVENTION

In accordance with the present invention, a sleeve assembly for sanding, rust removing and pit filling on a piston rod of a hydraulic cylinder or the like includes a sanding component. The sanding component comprises a rigid annular outer member, a resilient annular intermediate member adhesively secured to the inner surface of the outer member, and an abrasive annular inner member adhesively secured to the inner surface of the intermediate member for interference contact with the piston rod. Each member has first and second sections which engage and which include first and second end portions with opposed non-axial configurations which cooperate when the sections engage. With the inner member in interference contact with the piston rod, relative movement between the sleeve assembly and the piston rod in an axial direction is effected, either by actuating the piston rod or by manually moving the sleeve assembly. Preferably, the sleeve assembly is secured directly to the hydraulic cylinder structure. Clamp means releasably engages the members of the sanding component about the piston rod.

BRIEF DESCRIPTION OF THE DRAWINGS

Other objects and advantages of the invention will become apparent upon reading the following Detailed Description and upon reference to the Drawings, in which.

DETAILED DESCRIPTION OF THE INVENTION

Figure 1:
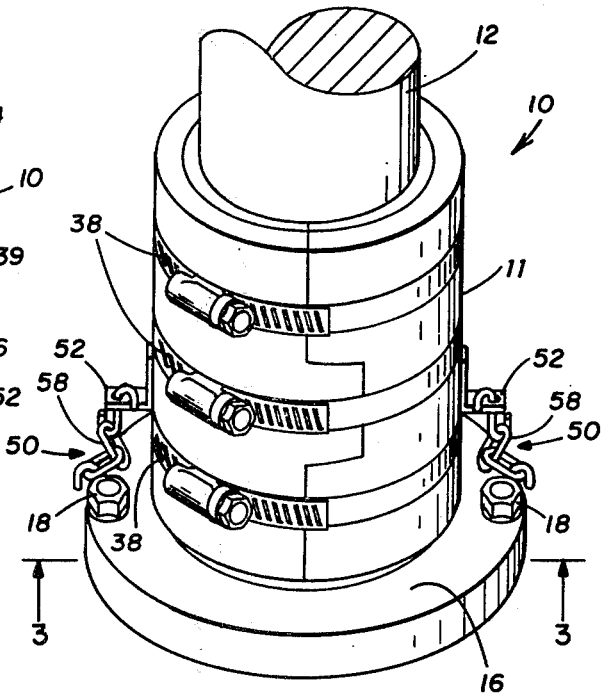
FIG. 1 is a perspective view of a first embodiment of the sanding sleeve assembly incorporating the invention engaged about a piston rod.
Figure 4:
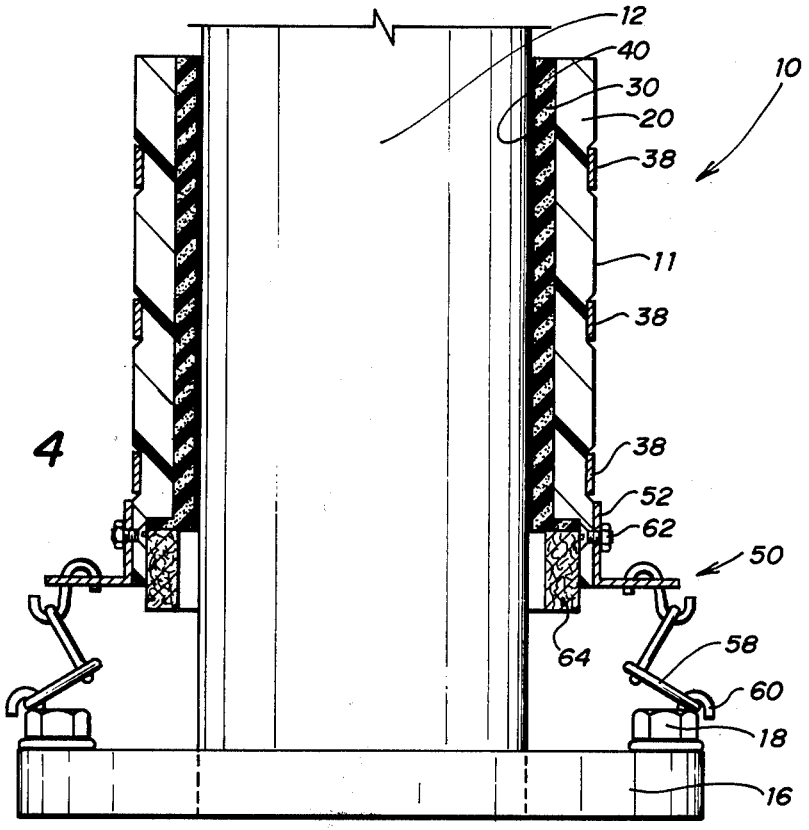
FIG. 4 is a sectional view of a first modification of the embodiment shown in FIGS. 1, 2 and 3.
Figure 7:
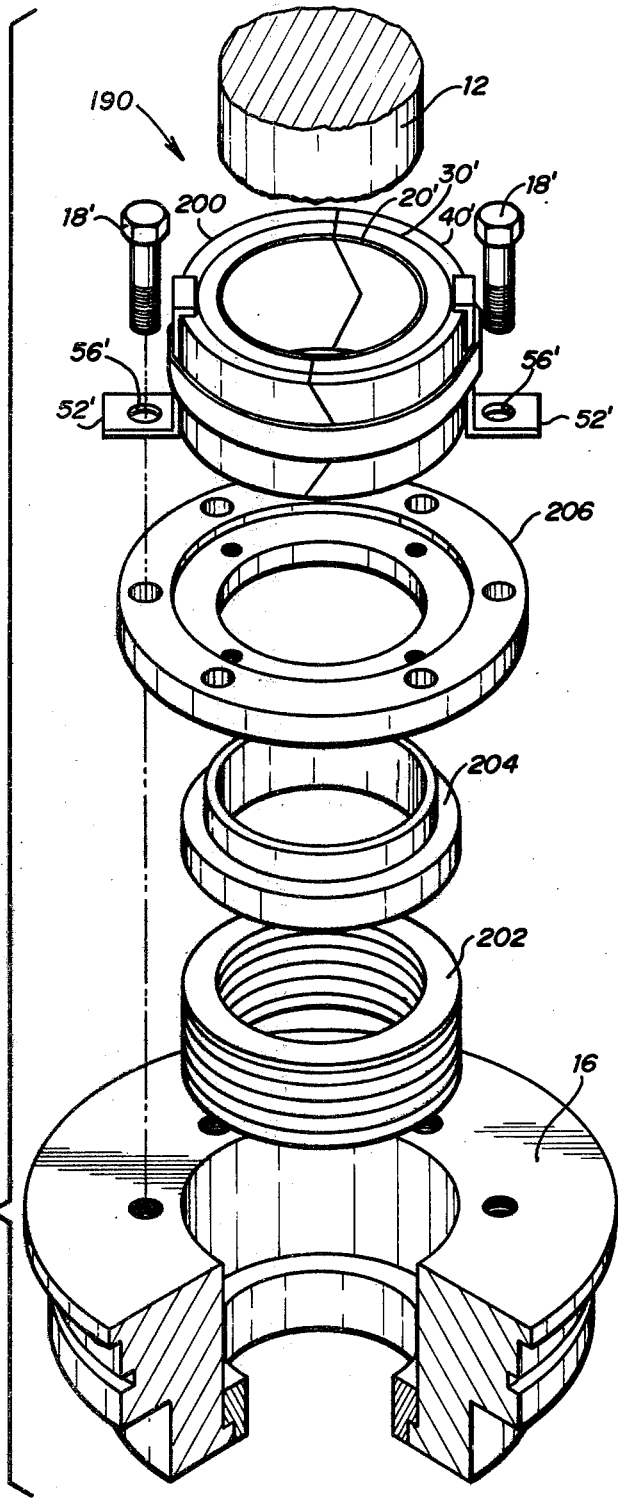
FIG. 7 is an exploded view of a second embodiment of the sanding sleeve assembly incorporating the invention engaged about a piston rod.

Referring now to FIGS. 1, 4 and 7, there is shown a sleeve assembly generally referred to as reference numeral 10. Sleeve assembly 10 is releasably engageable about a piston rod such as piston rod 12 which is normally part of apparatus for a hydraulic cylinder used in hydraulic elevator shafts, but may be used for any piston-type apparatus. Sleeve assembly 10 includes sanding component 11. This component of sleeve assembly 10 is engaged independently about piston rod 12 to produce the desired smooth outer surface on said piston rod.

Figure 2:
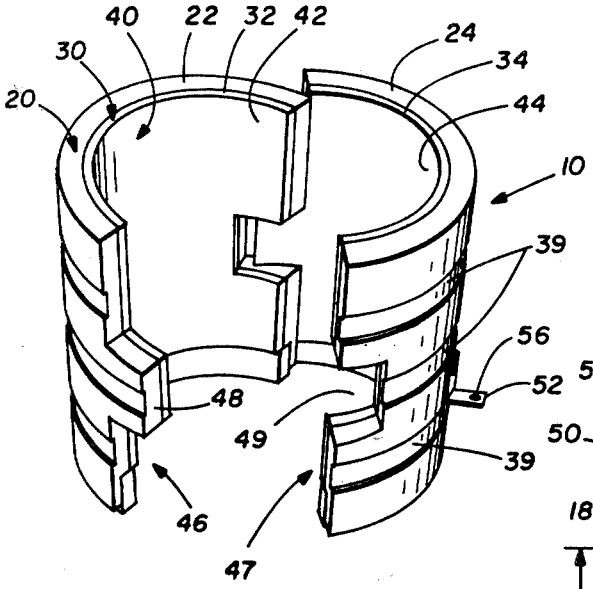
FIG. 2 is an exploded view of the embodiment of FIG. 1.
Figure 3:
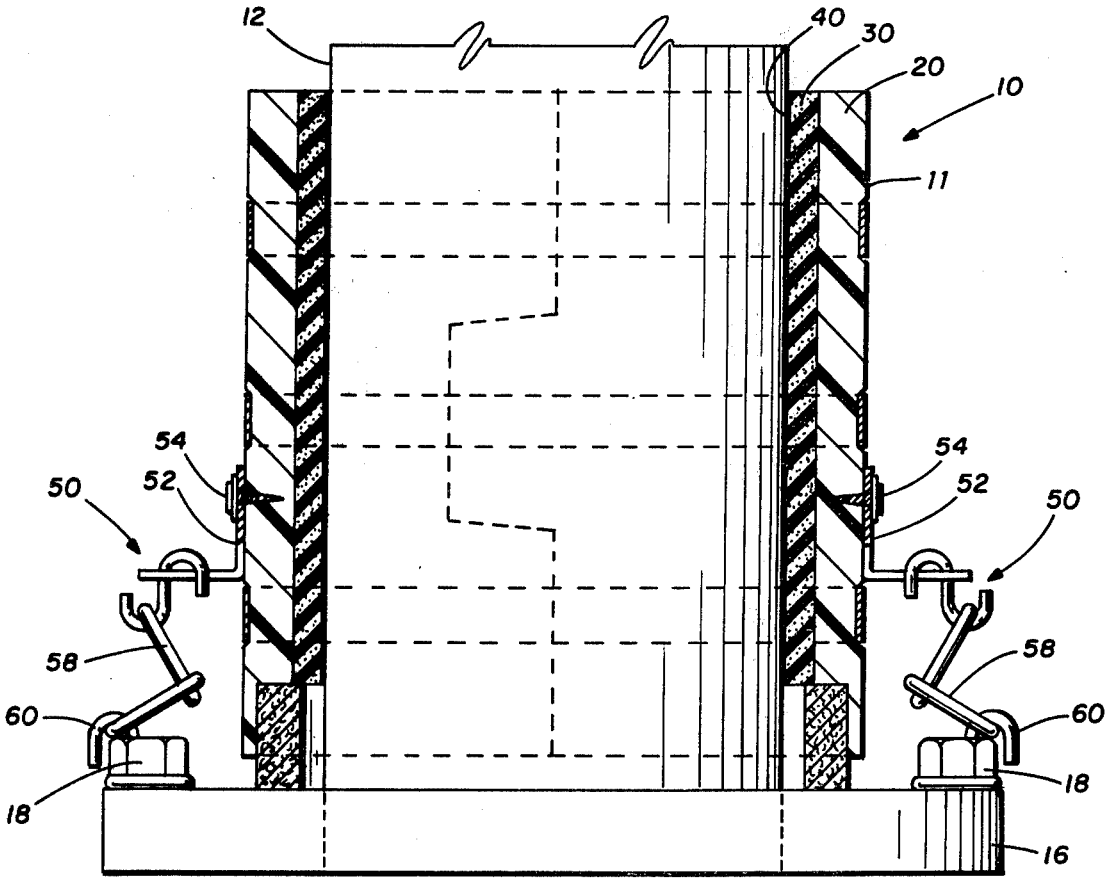
FIG. 3 is a sectional view taken along the lines 3—3 of FIG. 1.

Referring now to FIGS. 1, 2, and 3, the sanding component 11 of sleeve assembly 10 includes rigid annular outer member 20, resilient annular intermediate member 30, and abrasive annular inner member 40. Members 20, 30, and 40 of sanding component 11 are annular in construction and completely encircle piston rod 12 during normal operation of sanding sleeve assembly 10. Members 20, 30, and 40 cooperate together to sand the outer surface of piston rod 12, thereby smoothing rough joints, removing layers of rust, and removing the rifling effect caused by use of the belt sander.

As seen more clearly in FIG. 2, outer member 20 is comprised of first and second sections 22 and 24 which engage with each other to form outer member 20. Outer member 20 provides a solid portion of sanding sleeve assembly 10 whereby clamp means may encircle the outer member without crushing or collapsing sanding component 11. Sections 22 and 24 are constructed from any rigid material, but preferably are constructed from a phenolic material.

Intermediate member 30 is comprised of sections 32 and 34 which are adhesively secured to the inner surface of sections 22 and 24 of outer member 20. Intermediate member 30 provides the means for inner member 40 to adhere thereto, yet permitting easy replacement of inner member 40 as hereinafter described. Sections 32 and 34 are generally constructed from a resilient elastomeric material such as a foam or sponge type elastomeric material, but other materials of equal facility may be utilized. Sections 32 and 34 are secured to the inner surface of outer member 20 by a suitable adhesive such as rubber cement, manufactured by Le Pages.

Inner member 40 is comprised of sections 42 and 44 which are adhesively secured to the inner surface of sections 32 and 34 of intermediate member 30. Inner member 40 acts directly upon piston rod 12 to sand the outer surface of piston rod 12. Sections 42 and 44 of inner member 40 are generally comprised of a layer of abrasive material such as sandpaper, emery cloth, crocus cloth or the like, which are suitable for sanding a metallic surface such as piston rod 12. Suitable adhesive such as that described for use on sections 32 and 34 of member 30 may be used for sections 42 and 44 of member 40. Although sections 42 and 44 are adhesively secured to the inner surface of intermediate member 30, they may be easily removed therefrom for replacement purposes following wear through usage of sanding sleeve assembly 10 with piston rod 12. Thus, the present invention provides a means for sanding the outer surface of piston rod 12 and upon prolonged use and wear of the sections 42 and 44 of inner member 40, easy replacement may be effected and if further sanding is desired, little time is lost in effectuating a replacement of the sections 42 and 44 of inner member 40.

Sanding component 11, and particularly inner member 40, is designed to come in interference contact with piston rod 12 when the sections of members 20, 30 and 40 engage with each other. After sanding assembly 10 encircles piston rod 12, relative movement in an axial direction between the sanding assembly and piston rod 12 is effected, either by actuating the piston rod 12 or by manually moving the sanding assembly. Through this action, piston rod 12 is sanded to remove foreign materials that are relatively hard in nature, to smooth rough joints between adjacent sections, and to remove the rifling effect on a piston rod caused by use of a belt sander. Thus, sanding assembly 10 provides apparatus for placing a piston rod of a hydraulic cylinder or the like in proper condition for smooth operation of the piston rod.

Sections 22 and 24, 32 and 34, and 42 and 44 of members 20, 30 and 40, respectively, each include first and second end portions 46 and 47 which have opposed non-axial configuration. End portion 48 of one section of a member mates with end portion 49 of an opposed section of the same member to form a cylinder-like member. End portions 48 and 49 should have a non-axial configuration so that the sleeve assembly 10 does not score the piston rod. For example, stepped, inclined, mitered or pointed configuration may be used. In the preferred embodiment, end portion 46 includes a nose portion 48 which is releasably engageable into a cavity 49 of end portion 47. When the sections of members 20, 30 and 40 are engaged, nose 48 of end portion 46 engages in the cavity 49 of end portion 47 and the sections cooperate to form a uniform cylinder-like body encircling piston rod 12.

Members 20, 30 and 40 of sanding component 11 are releasably engageable about piston rod 12 and are held in the engaged position by a plurality of clamps 38 which fit within grooves 39 of outer member 20. In the preferred embodiment, clamps 38 are hose type clamps which may be expanded or contracted in circumference in the conventional manner. Thus, clamps 38 fit within grooves 39 of outer member 20 to releasably engage sanding assembly 10 about the piston rod 12.

Sanding sleeve assembly 10 further includes chain assembly 50 which retains the sanding component 11 in the vicinity of a stuffing box 16 into which piston rod 12 is received. Chain assembly 50 includes angle bars 52 which are L-shaped in construction and are screwed with screws 54 to sections 22 and 24 of outer member 20. Angle bars 52 have apertures 56 into which the upper end of S links is inserted. The lower end of links 56 is connected to hooks 60 which are secured to stuffing box 16 by bolts 18.

In reference to FIG. 4, there is shown a first modification of sanding sleeve assembly 10. In some applications, a stronger, more durable connection with stuffing box 16 may be required. In place of screws such as screws 54, angle bars 52 can be secured to sanding component 11 with bolts 62 extending completely through annular outer member 20. As shown in FIG. 4, bolts 62 interconnect angle bars 52 and member 20 in a notched portion of outer annular member 20 at the lower end of sanding sleeve assembly 10. If desired, a ring 64 of resilient material can be attached to the inside notched portion of outer member 20 at the lower end of component 11 to cushion the impact between component 11 and stuffing box 16 when piston rod 12 reverses direction and moves inwardly with respect to the hydraulic cylinder. If it were desired to more permanently secure sanding sleeve assembly 10 to stuffing box 16, it will be apparent that bolts 18 could be utilized to secure angle bars 52 directly without chain assembly 50.

Figure 5:
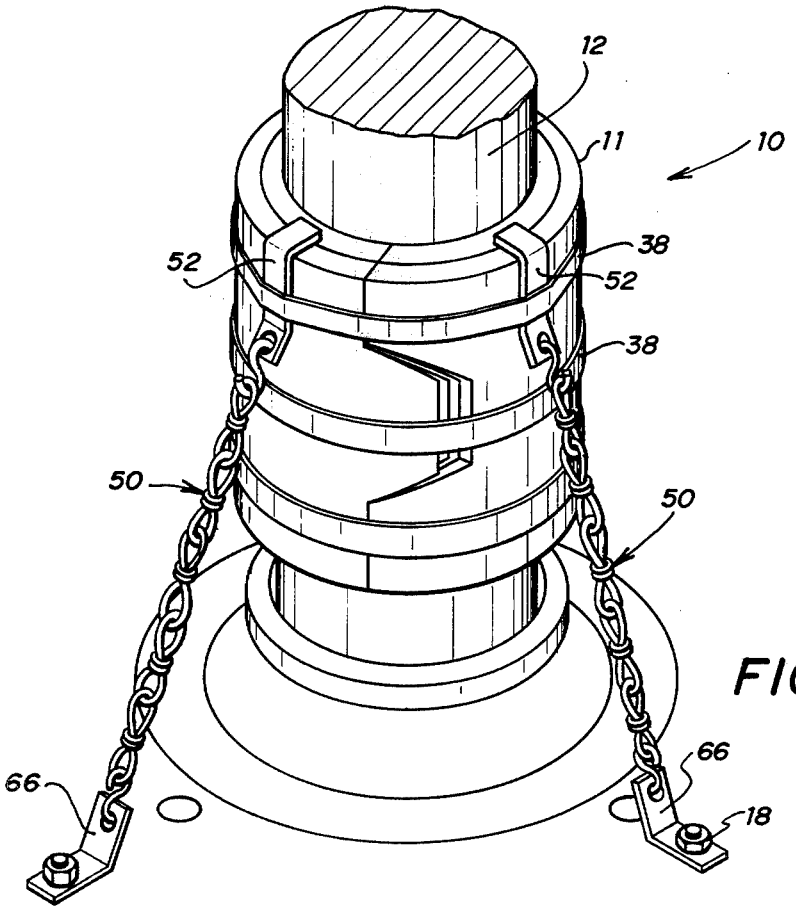
FIG. 5 is a perspective view of a second modification of the embodiment shown in FIGS. 1, 2 and 3.

Having reference to FIG. 5, there is shown a second modification of sanding sleeve assembly 10. FIG. 5 also pertains to an alternate configuration for angle bars 52. In this modification, angle bars 52 are engaged against the outer annular member of component 11 by at least one clamp 38. If desired, angle bars 52 could be extended to pass beneath more than one of clamps 38. The upper ends of angle bars 52 are turned inwardly to form a lip for engaging the top end of sanding component 11. A relatively longer chain assembly 50 is required to interconnect each angle bar 52 with a bracket 66 fixedly secured by a bolt 18. Thus, with the modification illustrated in FIG. 5, sanding sleeve assembly 10 is retained at the upper end thereof to permit more convenient manipulation of chain assemblies 50.

Figure 6:
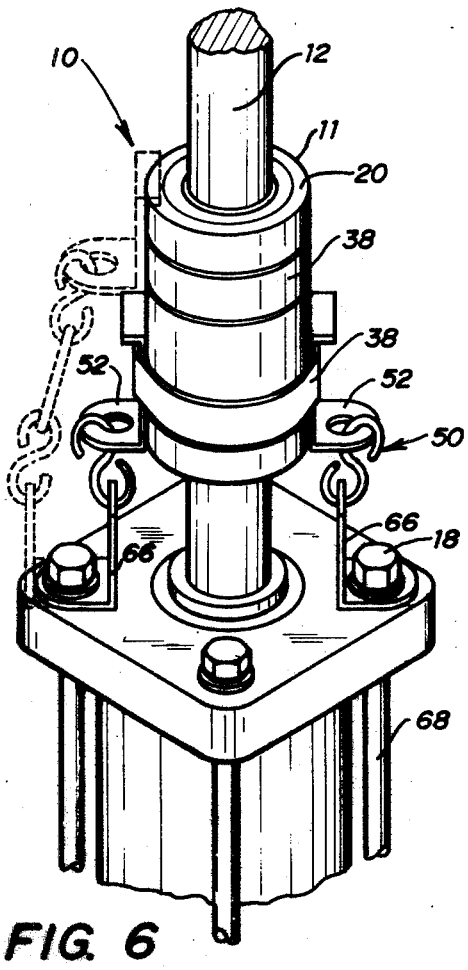
FIG. 6 is a perspective view of a third modification of the embodiment shown in FIGS. 1, 2 and 3.

In reference to FIG. 6, there is shown another modification of sanding sleeve assembly 10. The modification illustrated in FIG. 6 is particularly suited for use with hydraulic cylinders of the type utilizing tie rods 68 interconnecting end plates. As shown in full lines, angle bars 52 pass between outer member 20 and at least one clamp 38. The upper ends of angle bars 52 are turned to engage the edge of clamp 38 and thus secure component 11. Chain assembly 50 comprising one S link is utilized to interconnect each angle bar 52 with a bracket 66 fixed between bolt 18 and tie rod 68. If desired, the upper ends of angle bars 52 can be turned inwardly to engage the upper end of sleeve assembly 10, as shown in phantom lines.

Figure 8:
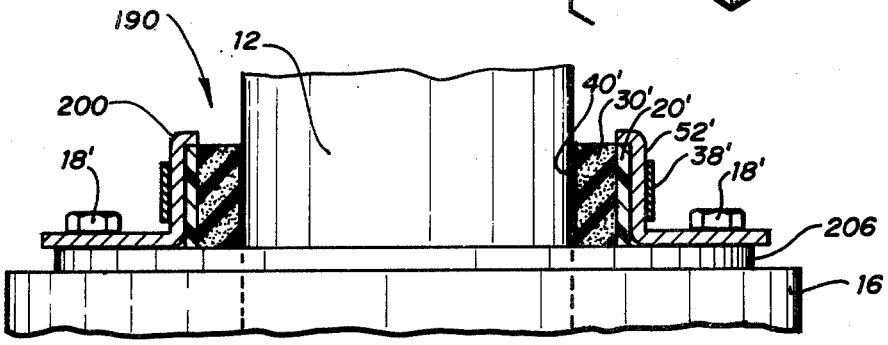
FIG. 8 is a sectional view of the embodiment shown in FIG. 7.

Referring now to FIGS. 7 and 8, there is shown sanding sleeve assembly 190 comprising a second embodiment of the invention. Sleeve assembly 190 includes a sanding component 200 with parts which are substantially identical in construction and operation to the parts of sanding sleeve assembly 10 illustrated in FIGS. 1–6. Such identical parts are designated in FIGS. 7 and 8 with the same reference numeral utilized in the description of sanding sleeve assembly 10, but are differentiated therefrom by means of a (') designation.

The chief distinction between sanding sleeve assemblies 190 and 10 is the absence of a readily releasable connection between sleeve assembly 190 and stuffing box 16. In particular, sanding component 200 is well suited for attachment to a hydraulic cylinder for an extended period of time. Sanding sleeve assembly 190 is rigidly secured to the hydraulic cylinder so as to maximize the surface wiped on the piston rod 12. FIG. 7 illustrates the end of a conventional hydraulic cylinder having a stuffing box 16 with a packing 202 and bearing 204 compressed therein by a gland ring 206. Sanding sleeve assembly 190 is bolted through apertures 56' in angle bars 52' and through ring 206 to stuffing box 16 directly. Angle bars 52' pass between clamp 38' and the outer surface of annular outer member 40'. The upper ends of angle bars 52' are turned to form a lip for engaging either the upper end of component 200 as shown, or for engaging the edge of clamp 38' (not shown) and thus restrain sanding sleeve assembly 190. Consequently, a tight connection results between sleeve assembly 190 and the hydraulic cylinder which maximizes the piston surface wiped and which permits semi-permanent installation. In all other respects, sanding sleeve assembly 190 operates substantially the same as sleeve assembly 10 discussed hereinbefore.

Figure 9:
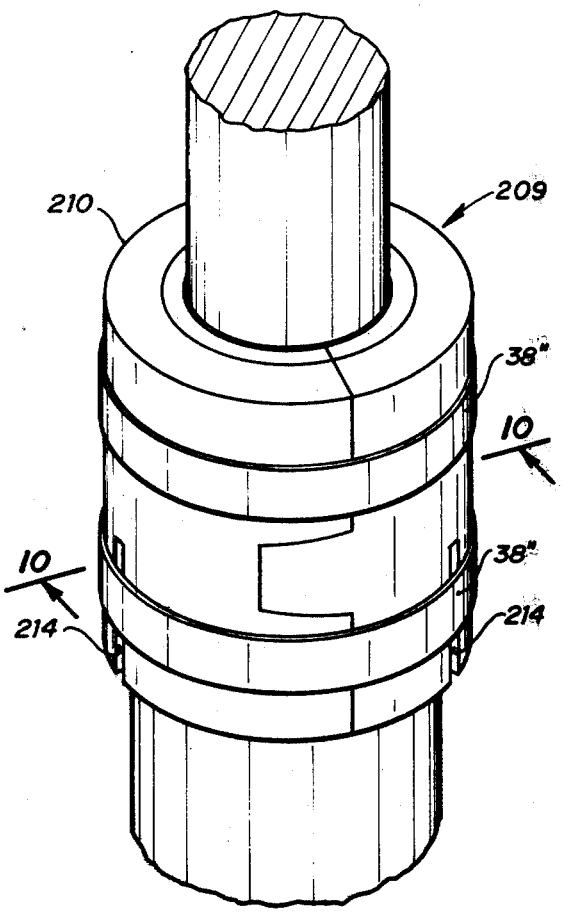
FIG. 9 is a perspective view of a third embodiment of the sanding sleeve assembly incorporating the invention engaged about the end of a hydraulic cylinder and the piston rod.
Figure 10:
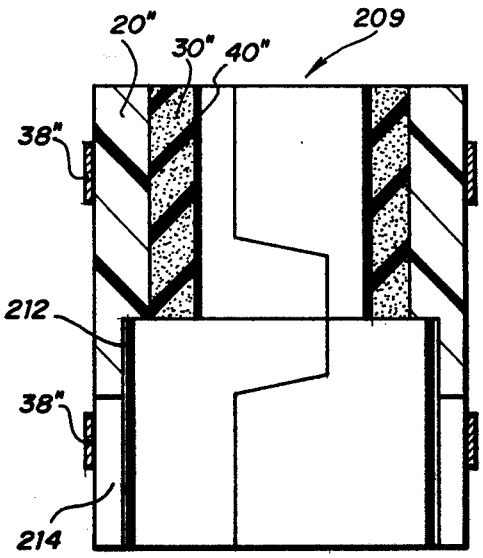
FIG. 10 is a sectional view taken along lines 10—10 of FIG. 9.
Figure 11:
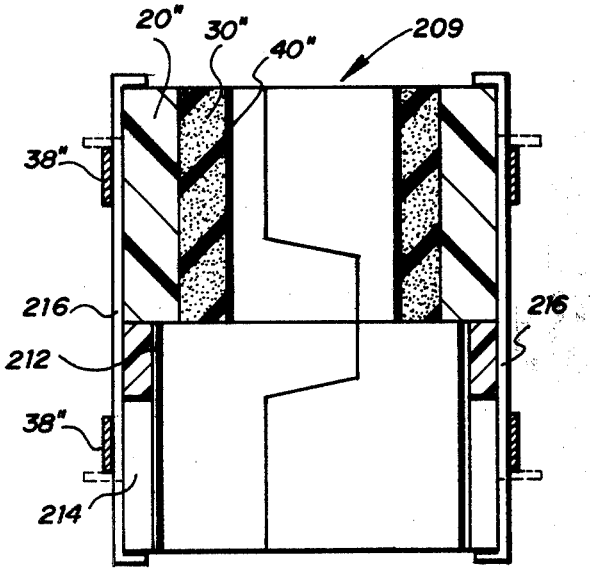
FIG. 11 is a sectional view of a modification of the embodiment shown in FIGS. 9 and 10.

In reference to FIGS. 9–11, there is shown a sanding sleeve assembly 209 comprising a third embodiment of the invention. Sleeve assembly 209 includes a sanding component 210 with parts which are substantially identical in construction and operation to the parts of sleeve assembly 10 illustrated in FIGS. 1–6. Such identical parts are designated in FIGS. 9–11 with the same reference numeral utilized in the description of sleeve assembly 10, but are differentiated therefrom by means of a double prime (") designation.

The primary distinction characterizing sleeve assembly 209 is the notched or indented configuration of annular outer member 20" in conjunction with the specific placement of resilient annular intermediate member 30" and abrasive annular inner member 40". The hydraulic cylinder and piston rod have been omitted from FIG. 10 for clarity. As is shown in FIG. 10, intermediate member 30" is adhesively secured to the inner surface of outer member 20" at the upper end only of component 210. Abrasive inner member 40" in turn is adhesively secured to intermediate member 30" for interference contact with the surface of piston rod 12. Annular member 212 is adhesively secured to the inside, notched surface of outer member 20" at the lower end of of component 210. Member 212 is constructed of a resilient, skid resistant material, such as rubber or other suitable elastomeric materials. It will thus be apparent that the lower end of component 210 defines a relatively greater inside diameter than does the upper end. Sanding sleeve assembly 209 is particularly suited for use with hydraulic cylinders of the smaller size, self-contained type having no stuffing box, bolts, tie rods or other structure available for securing a sanding sleeve assembly.

In particular, sleeve assembly 209 is adapted to be securely clamped at the lower end about the end of such a hydraulic cylinder so that the piston rod 12 extends through the upper end of component 210 in interference contact with abrasive inner member 40". Clamps 38" are utilized to releasably engage the complementary, non-axial end portions of each section of component 210. One clamp 38" surrounds the upper end of component 210 engaging the hydraulic cylinder. If desired, grooves (not shown) can be provided in the outer surface of member 20" to receive clamps 38". Preferably, axial slots 214 are provided in annular outer member 20" to allow for contraction as sleeve assembly 209 is securely clamped to the hydraulic cylinder.

If desired, component 210 can be of split construction incorporating retainers 216 to releasably interconnect the upper and lower ends of component 210 as shown in FIG. 11. Positioned between clamps 38" and annular outer member 20", retainers 216 include ends turned to engage the ends of component 210 as shown in full lines, or turned to engage the edges of clamps 38" as shown in phantom lines. Thus, by means of the modification shown in FIG. 11, the upper end of component 210 can be easily disconnected for replacement of either member 30" or 40" while the lower end of component 210 remains secured to the hydraulic cylinder. In all other respects, the sanding sleeve assembly 209 depicted in FIGS. 9–11 operates substantially the same as the embodiments hereinbefore discussed.

Figure 12:
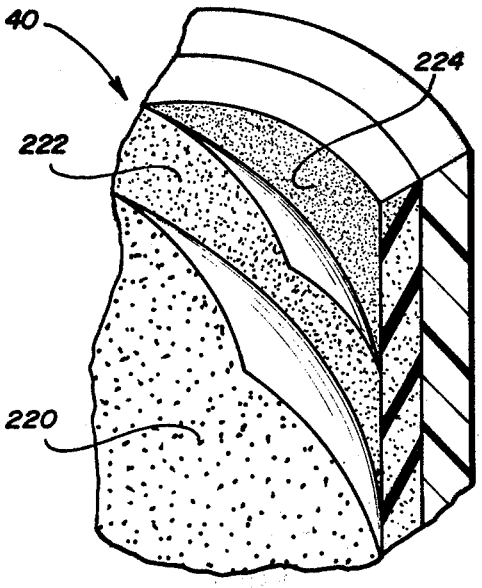
FIG. 12 is a partial illustration of a modification for the abrasive annular inner member of the sanding sleeve assemblies incorporating the invention.

Turning now to FIG. 12, there is shown a modification of the abrasive annular inner member which could be incorporated in place of members 40, 40' or 40" of any of the sanding sleeve embodiments of the invention. Instead of a single layer of abrasive material, such as sandpaper, emery cloth, crocus cloth or the like, the modification lies in the use of a plurality of abrasive layers of different grades. This form of layered construction for the abrasive annular inner member has been found more expedient. As shown for example in FIG. 12, abrasive annular inner member 40 comprises layers 220, 222 and 224. Layer 220 first comes into interference contact with the piston rod and comprises a coarse grade of abrasive. Layer 222 is the next layer to sand the piston rod and comprises a medium grade of abrasive. Finally, layer 224 comprises a fine grade of abrasive and is the last layer of abrasive to sand the piston rod. In this this manner, the the piston rod can be sanded for a period with a coarse abrasive followed by a periods of sanding with a progressively finer abrasives. Of course, more than three layers of relatively different grades of abrasive can be utilized, if desired.

When sanding sleeve assembly 10 is used to sand or remove foreign material on piston rod 12, and piston rod 12 is actuated in an axial direction, sanding component 11 is retained near the hydraulic cylinder. If manual movement of sanding component 11 is desired, component 11 is unfastened so that free movement of sanding component 11 in an axial direction along the length of piston rod 12 is possible. Thus, sanding sleeve assembly 10 sands and removes foreign material on piston rod 12 by actuating either piston rod 12 or sanding component 11 in an axial direction. If desired, the sanding component of any of the sanding sleeve embodiments of the invention can be so actuated manually.

Thus, it is apparent that there has been provided, in accordance with the present invention, a sleeve assembly that fully satisfies the aims and advantages set forth above. While the invention has been described in conjunction with specific embodiments thereof, it is evident that many alternatives, modifications and variations will be apparent to those skilled in the art in light of the foregoing description. Accordingly, the invention is intended to embrace all such alternatives, modifications, and variations as fall within the spirit and broad scope of the appended claims.

What is claimed is:

1. A sleeve assembly for sanding a piston rod in a hydraulic cylinder or the like having a stuffing box, which comprises:

an annular outer member comprised of a rigid material having first and second sections which engage to surround the piston rod;

an annular intermediate member comprised of an elastomeric material having first and second sections adhesively secured to the inner surfaces of the first and second sections of the outer member;

An annular abrasive inner member having first and second sections adhesively secured to the inner surfaces of the first and second sections of the intermediate member for interference contact with the piston rod;

the first and second sections of the annular members each having first and second end portions with opposed complementary non-axial configurations such that the sleeve assembly does not score the piston rod during axial movement therebetween while sanding the piston rod;

at least one hose clamp means surrounding the annular outer member for releasably engaging the first and second sections of each of said annular members;

the annular outer member including a like number of peripheral grooves each for receiving one of the hose clamps therein;

at least two chain means each having first and second ends for extending between the annular outer member and the stuffing box for releasably securing the sleeve assembly to the hydraulic cylinder whereby relative movement between the piston rod and the sleeve assembly is affected by translation of the piston rod;

at least two bracket means affixed to said annular outer member, each of said bracket means releasably receiving the first end of one of said chain means;

each of said brackets having a portion extending along the annular outer member and an end portion turned to engage a predetermined portion of the sanding sleeve assembly; and means for releasably affixing the second end of each of said chain means to the stuffing box.

2. The sleeve assembly of claim 1 wherein the annular intermediate member is comprised of a foam type material.

3. The sleeve assembly of claim 1 wherein the annular abrasive inner member comprises a material selected from a group consisting of sandpaper, emery cloth and crocus cloth materials.

4. The sleeve assembly of claim 1 wherein each of said bracket means passes between at least one of the hose clamps and the annular outer member.

5. The sleeve assembly according to claim 4 wherein each of said bracket means includes at the upper end thereof a turned portion defining a lip for engaging the end of the outer annular member.

6. The sleeve assembly according to claim 4 wherein each of said bracket means includes at the upper end thereof a turned portion defining a lip for engaging the edge of one of the hose clamps surrounding the annular outer member.

7. A sleeve assembly for sanding a piston rod in a hydraulic cylinder or the like having a stuffing box, which comprises:

an annular outer member comprised of a rigid material having first and second sections which engage to surround the piston rod;

an annular intermediate member comprised of an elastomeric material having first and second sections adhesively secured to the inner surfaces of the first and second sections of the outer member;

an annular abrasive inner member having first and second sections adhesively secured to the inner surfaces of the first and second sections of the intermediate member for interference contact with the piston rod;

said first and second sections of the annular members each having first and second end portions with opposed complementary non-axial configurations such that the sleeve assembly does not socre the piston rod during axial movement therebetween while sanding the piston rod;

at least one hose clamp means surrounding the annular outer member for releasably engaging the first and second sections of each of said annular members;

at least two bracket means positioned between the outer surface of the outer member and at least one of the hose clamp means surrounding said outer member;

each of said bracket means having first and second ends, said first ends being turned inwardly to define lips for engaging the upper end of said outer annular member and said second ends being turned outwardly; and means for affixing the second end of each of said bracket means to the stuffing box.

8. The sleeve assembly of claim 7 wherein the annular outer member includes a plurality of peripheral grooves each for receiving one of said hose clamp means therein.

9. The sleeve assembly of claim 7 wherein the annular intermediate member is comprises of a foam type material.

10. The sleeve assembly of claim 7 wherein the annular abrasive inner member comprises a material selected from a group consisting of sandpaper, emery cloth and crocus cloth materials.

11. A sleeve assembly for sanding a piston rod in a hydraulic cylinder or the like, which comprises:

an annular outer member with upper and lower portions and comprised of a rigid material having first and second sections which engage to surround one end of the hydraulic cylinder;

an annular intermediate member comprised of an elastomeric material having first and second sections adhesively secured to the inner surfaces and about the upper portion of the outer member;

an annular abrasive inner member having first and second sections adhesively secured to the inner surfaces of the first and second sections of the intermediate member for interference contact with the piston rod;

an annular resilient inner member having first and second sections adhesively secured to the inner surfaces and at the lower portion of the outer member for surrounding engagement with the hydraulic cylinder;

said first and second sections of said annular members each having engaging end portions with opposed complementary non-axial configurations so that the sleeve assembly does not score the piston rod during axial movement therebetween while sanding the piston rod; and a plurality of hose clamp means surrounding the annular outer member for releasably engaging the first and second sections of each of said annular members, at least one of said hose clamp means being disposed about the lower end of the annular outer member for releasably clamping the sleeve assembly about the end of the hydraulic cylinder;

said annular center member including at least one slot formed in each section thereof and extending a predetermined distance from the lower end of said member.

12. The sleeve assembly of claim 11 wherein the annular outer member includes a plurality of peripheral grooves each for receiving one of said hose clamp means therein.

13. The sleeve assembly of claim 11 wherein said annular outer member is separated between the upper and lower portions, and further including means for releasably interconnecting said upper and lower portions of said sleeve assembly.

14. The sleeve assembly of claim 13 wherein the means for releasably interconnecting the portions of the sleeve assembly comprises at least two bracket means extending between the clamp means and the outer member, each of said bracket means including turned end portions defining lips for engaging and retaining the portions of said sleeve assembly.

15. The sleeve assembly of claim 11 wherein the annular intermediate member is comprised of a foam type material.

16. The sleeve assembly of claim 11 wherein the annular abrasive inner member comprises a material selected from a group consisting of sandpaper, emergy cloth and crocus cloth materials.

17. A sleeve assembly for sanding a piston rod in a hydraulic cylinder or the like of the type incorporating tie rods, which comprises:

an annular outer member comprised of a rigid material having first and second sections which engage to surround the piston rod;

an annular intermediate member comprised of an elastomeric material having first and second sections adhesively secured to the inner surfaces of the first and second sections of the outer member;

an annular abrasive inner member having first and second sections adhesively secured to the inner surfaces of the first and second sections of said intermediate member for interference contact with the piston rod;

said first and second sections of the annular members each having first and second end portions with opposed complementary non-axial configurations such that the sleeve assembly does not score the piston rod during axial movement therebetween while sanding the piston rod;

at least one hose clamp means surrounding the annular outer member for releasably engaging the first and second sections of each of said annular members;

at least two bracket means each passing between at least one of said hose clamp means and the outer surface of the annular outer member;

each of said bracket means having upper and lower ends, said upper ends being turned to define a lip for engagement with the sleeve assembly, and said lower ends being turned outwardly;

at least two chain means each having one end releasably secured to the lower end of one of said bracket means; and means for releasably securing the other ends of said chain means to the tie rods of the hydraulic cylinder whereby relative movement between the piston rod and the sleeve assembly is effected by axial movement of the piston rod.

18. The sleeve assembly of claim 17 wherein the outer annular member includes a like plurality of peripheral grooves each for receiving one of said hose clamp means therein.

19. The sleeve assembly of claim 17 wherein the annular intermediate member is comprised of a foam type material.

20. The sleeve assembly of claim 17 wherein the annular abrasive inner member comprises a material selected from a group consisting of sandpaper, emery cloth and crocus cloth materials.

21. The sleeve assembly of claim 17 wherein the outer annular member is comprised of a phenolic material.

* * * * *